US005979136A

United States Patent [19]

Marschak

[11] Patent Number: 5,979,136

[45] Date of Patent: Nov. 9, 1999

[54] PREFABRICATED STRUCTURE PANEL

[76] Inventor: Howard J. Marschak, 2934 Lakeshore Dr., Long Beach, Ind. 46360

[21] Appl. No.: 08/939,522

[22] Filed: Sep. 29, 1997

[51] Int. Cl.[6] ..... E04B 2/00

[52] U.S. Cl. ..... 52/588.1; 52/462

[58] Field of Search ..... 52/588.1, 579, 52/376, 462

[56] References Cited

U.S. PATENT DOCUMENTS

| | | | |
|---|---|---|---|
| 3,568,388 | 3/1971 | Flachbarth et al. | 52/588.1 |
| 3,820,295 | 6/1974 | Folley | 52/270 |
| 3,969,866 | 7/1976 | Kyne | 52/588.1 |
| 4,168,596 | 9/1979 | Yoder, Jr. . | |
| 4,267,679 | 5/1981 | Thompson | 52/311 |
| 4,594,822 | 6/1986 | Marschak | 52/90.1 |
| 5,117,602 | 6/1992 | Marschak | 52/376 |

*Primary Examiner*—Beth A. Aubrey
*Attorney, Agent, or Firm*—Emrich & Dithmar

[57] ABSTRACT

A structural member having an elongated front panel with lateral ends. Side panels extend generally perpendicularly from the front panel at the lateral ends. Each of the side panels has a generally Z-shaped portion therein with a flange at the end of each side panel having a portion thereof extending in the same direction and generally parallel to the front panel. Each of the flanges have another portion generally parallel to the adjacent side panel, so that adjacent cooperating structural members are nestable with each other at the Z-shaped portions thereof with the flanges of nested side panels cooperating to form an interlocking construction. Reinforcing members are provided at the top and bottom of a plurality of nested structural panels, along with top and bottom plates.

11 Claims, 5 Drawing Sheets

95
86
85
84
67
65
68
77
79
78
81
75
68
89
83
76
69
95
66
35
26
10
28
20
31
35
51
55
54
67
56
68
45
46
48
49
65
58
95
59
47
53
66
69
100

PREFABRICATED STRUCTURE PANEL

BACKGROUND OF THE INVENTION

The present invention relates to building construction and more particularly to an improved structural panel for use in erecting buildings wherein the panels may be used in place of studs sheathing and finished siding.

The use of roll formed panels for building construction has been known for many years. Examples of various types of building constructional components are disclosed in U.S. Pat. Nos. 3,820,295; 3,969,866; 4,168,596 and application's prior U.S. Pat. No. 4,594,822, all incorporated herein by reference.

For a long time, there has been needed in the construction industry, a mechanism to fabricate large panels or walls in order to reduce the amount of labor necessary to construct a building. Labor costs in building construction has become one of most significant costs and prefabricated panels provide an extremely efficient mechanism for reducing the amount of labor required to construct a building. Accordingly, the present invention fulfills a need for a panel construction in the industry which can be made of various heights or longitudinal dimensions in order to assemble at the site, panels which may be anywhere from one to four stories high.

This is an improvement of my prior U.S. Pat. No. 5,117,602.

SUMMARY OF THE INVENTION

According to the present invention, a unique constructional panel has been developed which can be utilized without the need for conventional studs and/or joists.

An object of the invention is to provide a structural member having an elongated front panel with lateral ends, side panels extending generally perpendicular from the front panel and joined thereto at a respective one of the lateral ends, each of the side panels having a generally Z-shaped portion therein, and a flange at the end of each side panel having a portion thereof extending in the same direction and generally parallel to the front panel, each of the flanges having another portion thereof generally parallel to the adjacent side panel, whereby adjacent cooperating structural members are nestable with each other at the Z-shaped portions thereof with the flanges of nested side panels cooperating to form an interlocking construction.

Another object of the invention is to provide a plurality of structural members connected together forming a building wall, each structural member having an elongated front panel with lateral ends and side panels extending generally perpendicularly from the front panel and joined thereto at a respective one of the lateral ends, each of the side panels having a generally Z-shaped portion therein, a flange at the end of each side panel having a portion thereof extending in the same direction and generally parallel to the front panel, each of the flanges having another portion thereof generally parallel to the adjacent side panel, adjacent structural members being nested with each other at the Z-shaped portions thereof with the flanges of nested side panels cooperating to form an interlocking construction for a wall, and reinforcing members near the top and bottom of the front panel between the lateral ends thereof, and means connecting adjacent side panels to form supports for a building wall or ceiling or floor.

Another object of the invention is to provide a building including of a plurality of structural members connected together forming interconnected walls, each structural member having an elongated front panel with lateral ends and side panels extending generally perpendicularly from the front panel and joined thereto at a respective one of the lateral ends, each of the side panels having a generally Z-shaped portion therein and a flange at the end of each side panel having a portion thereof in the same direction and generally parallel to the front panel each of the flanges having another portion thereof generally parallel to the adjacent side panel, away from the front panel, means connecting adjacent structural members to form the building walls with the two connected side panels forming a nested configuration, reinforcing members positioned generally horizontally between the side panels of structure members to strengthen the structural members, and a top plate horizontally extending across the tops of the wall forming structural members enclosing the tops of same.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
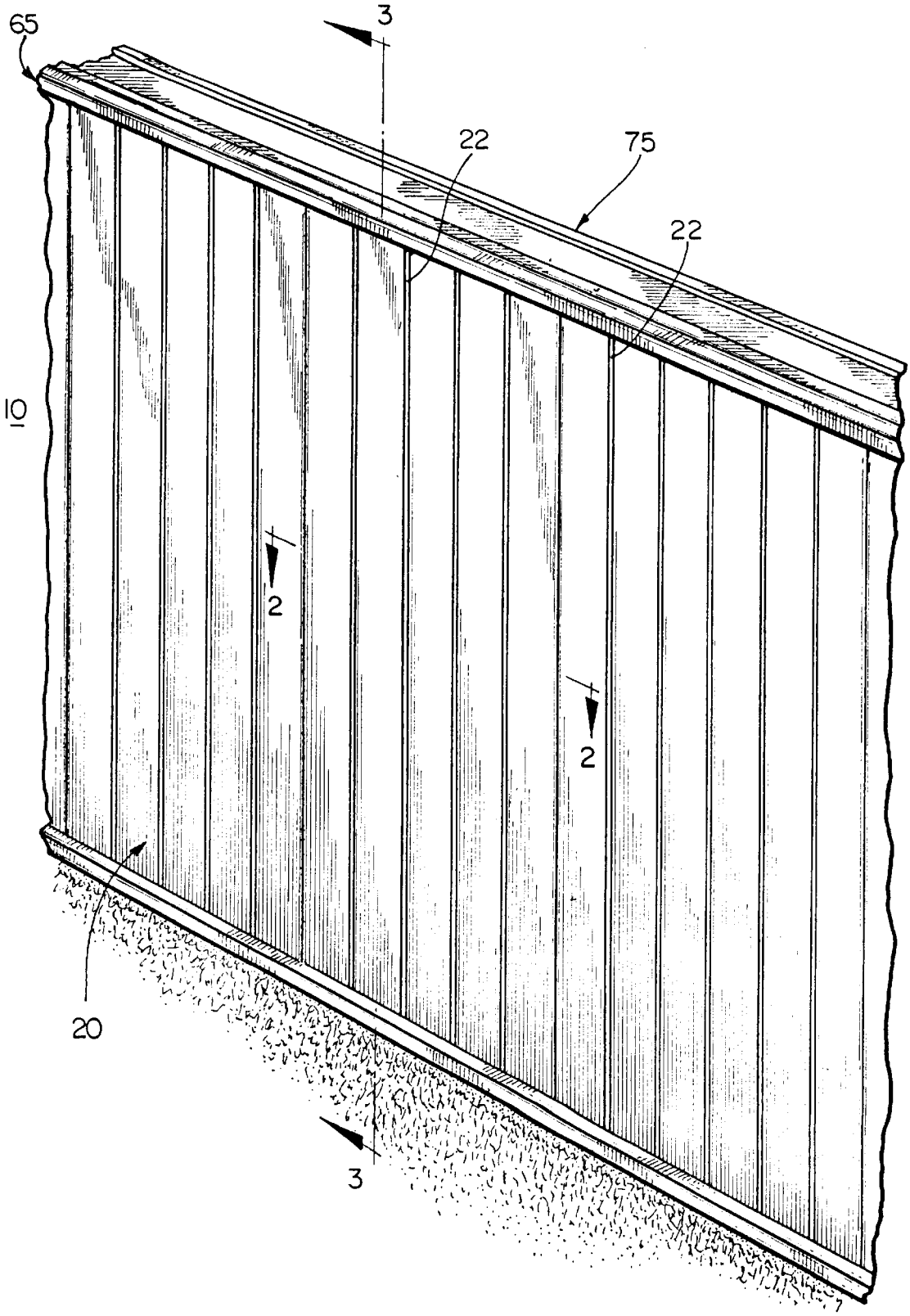
FIG. 1 is a elevational view of a portion of a building wall constructed with the panels of the present invention.
Figure 2:
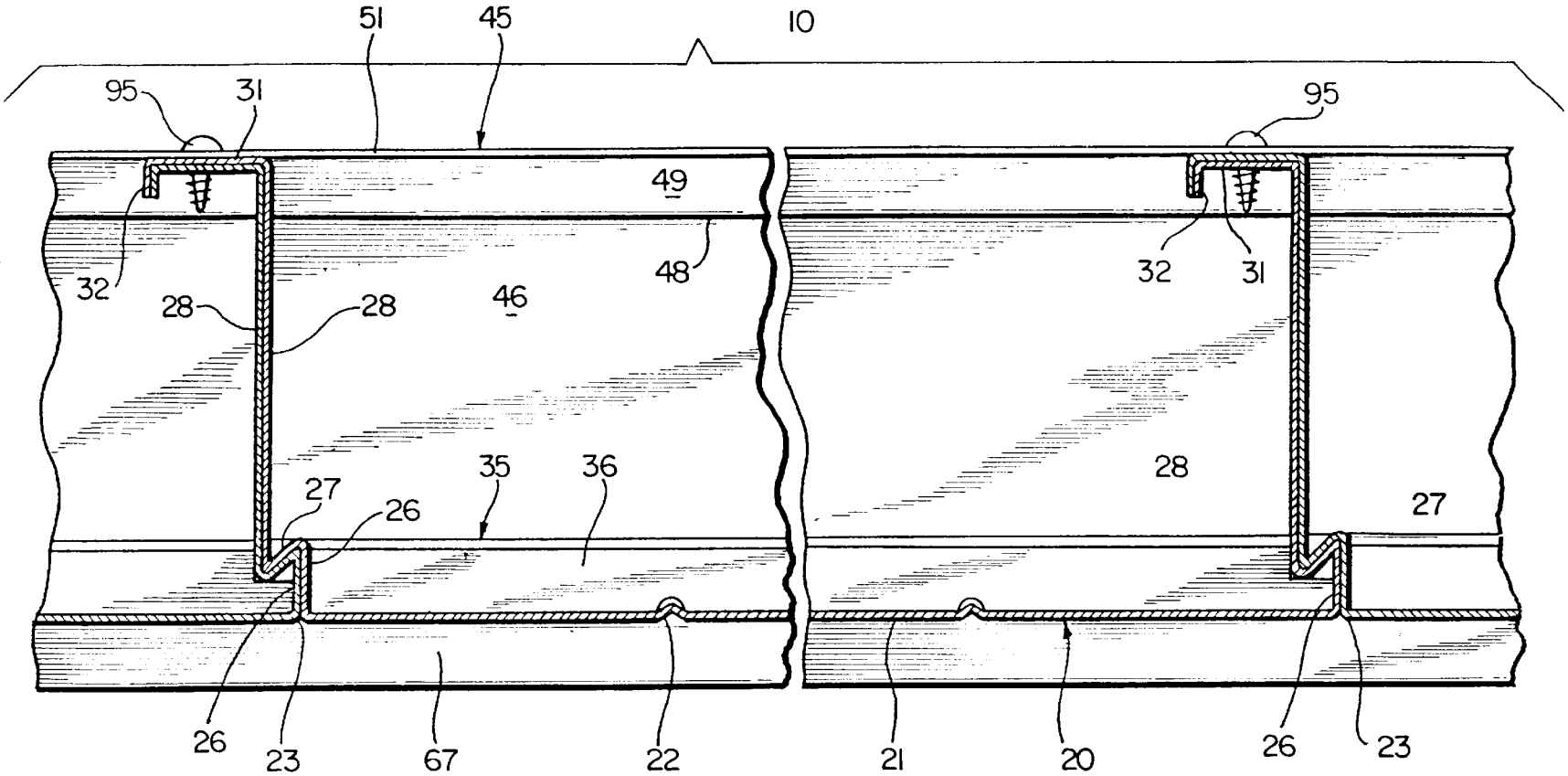
FIG. 2 is a cross-sectional view of the wall illustrated in FIG. 1 as seen along lines 2—2 thereof.

Referring now to the drawings, there is disclosed a wall construction 10 made up of a plurality of structural members 20, each structural member having a generally planar front panel 21 having a plurality of longitudinally extending stiffening ribs 22 and terminating in lateral ends 23. A side panel 25 extends generally perpendicularly from the front panel 21 at each lateral end 23. Each of the side panels 25 is made up of a straight portion 26 extending generally perpendicularly to the front panel 21 and an angular portion 27 integral with the straight portion 26 and extending angularly toward the front panel 21. Thereafter, a straight portion 28 extending rearwardly of the portion 27 thereby to form a generally Z-shaped section as previously illustrated in my '602 patent, the disclosure of which is herein incorporated by reference. At the distal end of the side panel 25 away from the front panel 21 is a flange 31 extending generally perpendicularly to the side panel 25 and particularly to the portion 28 thereof. The flange 31 ends in a distal end portion 32 positioned perpendicularly to the flange 31 and parallel to the straight portion 28 of the side panel 25, as best seen in FIGS. 2, 4 and 6 of the drawings.

Figure 6:
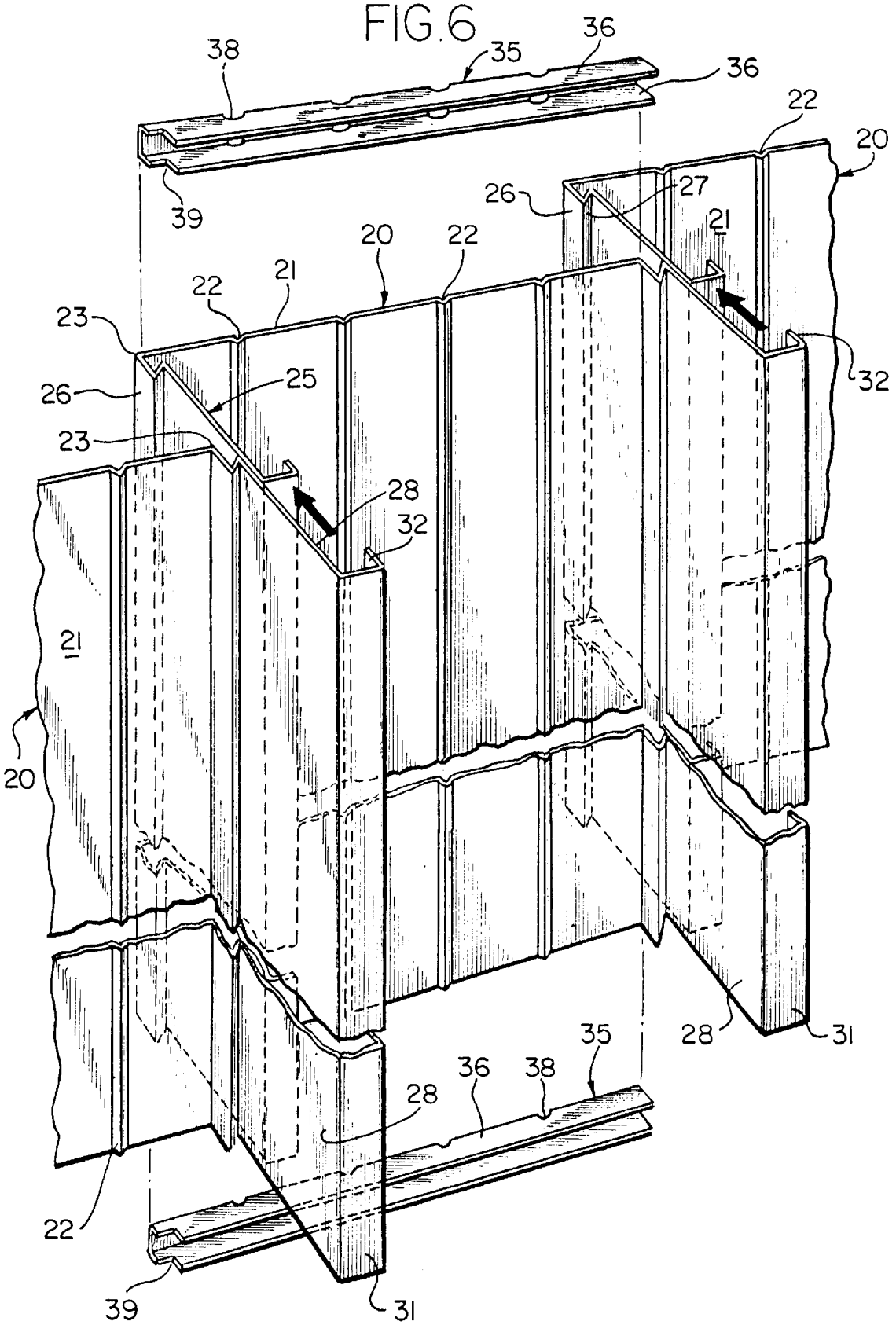
FIG. 6 is an exploded view like FIG. 4 showing how the various structural panels fit together to form the structural member making up the wall of FIG. 1.

As best seen in FIGS. 3 through 6, each structural member panel 20 is provided with a panel reinforcing member 35 in the form of a C-shaped channel having opposed legs 36 interconnected by a bight 37. A plurality of semi-cylindrical notches 38 are positioned in each panel reinforcing member 35 to be in registry with each one of the stiffening ribs 22 which extend inwardly from the front panel 21. Notches 39 are provided in one of the legs 36 of the panel reinforcing member 35 to accommodate the angular portion 27 forming the Z-shaped portion of the side panel 25, as best seen in FIG. 6. FIG. 6 also shows the manner in which the various side panels 25 nest and how the panel reinforcing members 35 are provided at the top and at the bottom of the structural members 20.

Figure 3:
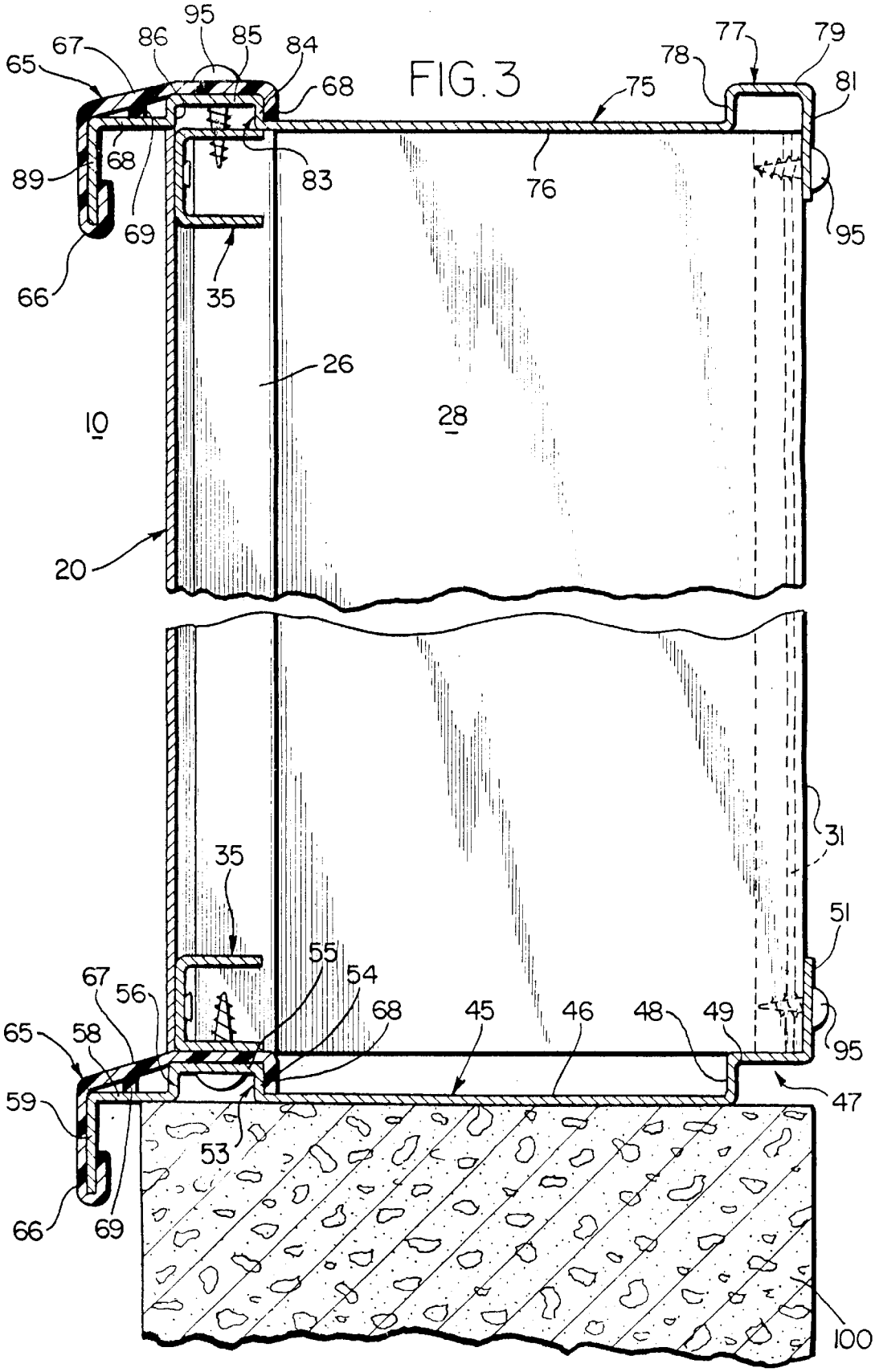
FIG. 3 is a cross-sectional view of the wall illustrated in FIG. 1 taken along lines 3—3 thereof.
Figure 4:
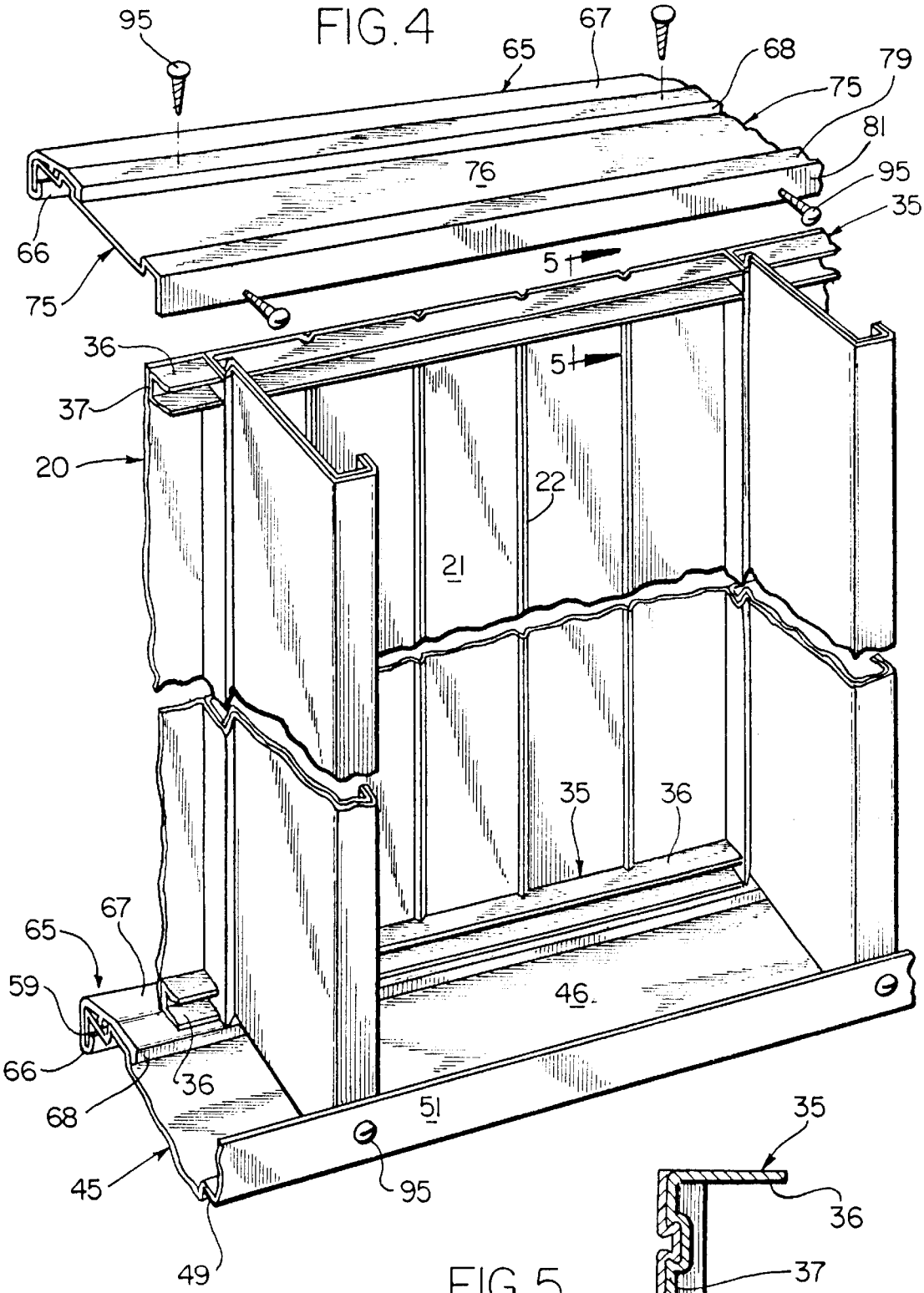
FIG. 4 is an exploded elevational view of the wall illustrated in FIG. 1 taken from the rear thereof showing the relationship between the various structural elements.
Figure 5:
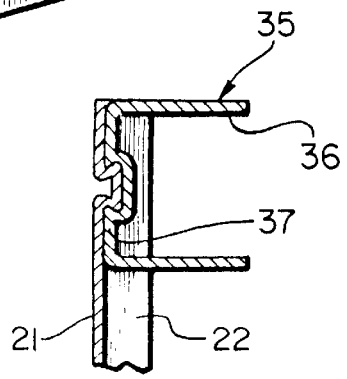
FIG. 5 is a view of the portion of the construction illustrated in FIG. 4 as seen along line 5—5 thereof.

As best seen in FIG. 4, there is further provided a bottom plate 45 which is irregular in configuration but serves to provide a support for the structural members 20, the bottom plate 45 is also seen in transverse cross section in FIG. 3. The bottom plate 45 includes a flat section 46 being preferably integrally connected to a stair step portion 47, as seen in FIG. 3, which includes a vertical portion 48 and a connected horizontal portion 47 which in turn is connected to an upstanding vertical portion 51 which forms a rear support for the end of the side panels 25 and particularly abuts the flanges 31 of the side panels 25.

The flat portion 46 of the bottom plate 45 has a front channel portion 53 preferably integrally connected to the flat portion 46. The front channel portion 53 includes a vertical leg 54 connected to or formed into a horizontal member 55 and another vertical leg 56. From the vertical leg 56, an outwardly extending flange portion 58 leads into a downwardly extending member 59. It is preferred that the entire bottom plate 45 be stamped or formed out of a single piece of metal thereby providing an integral structural component.

A water proof, preferably plastic, bottom and top strip 65 is illustrated. Although the strips 65 are the same for both the top and bottom, the strip 65 it will be explained in detail with respect to the bottom plate 45 although it also rests on a top plate 75 hereinafter to be described.

The water proof strip 65 has one end 66 thereof which fits over the downwardly extending flange portion 59 of the bottom plate 45 and an angular portion 67 which extends over the horizontal outwardly extending flange 58 of the bottom plate 45. The plastic bottom strip 65 also includes another end 68 which snap fits over the vertical leg 54 of the front channel portion 53, thereby to provide a water proof strip for the bottom of the structural member 20, there being provided a reinforcing rib 69 extending downwardly from the angular portion 67 to provide strength to the entire water proof strip 65. It should be understood that strip 65 extends the entire length of the bottom plate 45, as best seen in FIG. 4.

Referring to FIGS. 3 and 4, there is illustrated a top plate 75 which includes a flat section 76 having a channel rear portion 77 including a vertical leg 78 and a horizontal leg or portion 79 followed by a downwardly extending vertical flange 81, as best seen in FIG. 3. The top plate 75 also includes an integral front channel portion 83 which includes a vertical leg 84 integrally connected to the flat portion 76 and connected to a horizontal portion 85 ending in a downwardly extending vertical portion 86 which forms a generally U-shaped channel which fits over, as seen in FIG. 3, the top panel reinforcing member 35. Outwardly of the vertical leg 86 is an outwardly extending flange 88 similar to the flange 58 and a downwardly extending flange 89 similar in dimension to the flange 59, all to cooperate with and support the waterproof, preferably plastic, top strip 65 mounted thereon as illustrated in FIGS. 3 and 4.

The entire construction is held together by a plurality of threaded fasteners 95, as illustrated, which show that there are four fasteners 95 which hold the top plate 75 to the nested structural members 20 including reinforcing member 35 and there are four threaded fasteners 95 which hold the bottom plate 46 and the associated nested structural members 20 and reinforcing member 35 in fixed relation at the bottom. The exact kind of fasteners 95 used are well within the skill of the art to vary as needed.

While there has been disclosed what is considered to be the preferred embodiment of the present invention, it is understood that various changes in the details may be made without departing from the spirit, or sacrificing any of the advantages of the present invention.

I claim:

1. A plurality of structural members connected together forming a building wall, each structural member having an elongated front panel with lateral ends and side panels extending generally perpendicularly from said front panel and joined thereto at said lateral ends, each of said side panels having a generally Z-shaped portion therein, a flange at each distal end of each side panel having a portion thereof extending generally parallel to said front panel, each of said flanges having another portion thereof generally parallel to the adjacent side panels extending toward said front panel, structural members being nested with each other at the Z-shaped portions thereof with the flanges of nested side panels cooperating to form an interlocking construction for the building wall, reinforcing members near the top and bottom of said front panel between the lateral ends thereof, a top plate extending across the building wall, a bottom plate on which the building wall rests, a waterproofing strip intermediate the building wall and the bottom plate and a waterproofing strip overlying a portion of said top plate, and means connecting adjacent side panels to form supports for the building wall or a ceiling or a floor.

2. The structural member of claim 1, wherein said front panel is generally planar.

3. The structural members of claim 1, wherein each structural member is a single piece of steel.

4. The structural members of claim 1, wherein each front panel measures about 24 inches between said lateral ends.

5. The structural members of claim 3, wherein each front panel has a top edge and a bottom edge and extends in the range of from about 5 feet to about 40 feet between said top and bottom edges.

6. The structural member of claim 1, wherein the Z-shaped portions of said side panels are substantially the same.

7. The structural members of claim 1, wherein a plurality of stiffening ribs extend longitudinally along each front panel.

8. The plurality of structural members of claim 1, wherein said reinforcing members are elongated channels, generally C-shaped in transverse cross-section.

9. The plurality of structural members of claim 1, wherein said nested structural members are connected by a fastener.

10. The plurality of structural members of claim 9, wherein said fastener is a screw.

11. A building including a plurality of structural members connected together forming interconnected building walls, each structural member having an elongated front panel with lateral ends and side panels extending generally perpendicularly from said front panel and joined thereto at said lateral ends, each of said side panels having a generally Z-shaped portion therein and a flange at a distal end of each side panel having a portion thereof extending generally parallel to said front panel, each of said flanges having another portion thereof generally parallel to the side panels, extending toward said front panel, and spaced from said front panel, means connecting the side panels of adjacent structural members to form said building walls with the connected side panels forming a nested configuration, reinforcing members positioned generally horizontally between the side panels of said structural members to strengthen said structural members, a top plate horizontally extending across the tops of said walls forming structural members enclosing the tops thereof, a bottom plate supporting said structural members, and a waterproofing strip overlying a portion of said top plate.

* * * * *